US011800913B2

(12) United States Patent
Luo

(10) Patent No.: US 11,800,913 B2
(45) Date of Patent: Oct. 31, 2023

(54) HAND-PUSH SUNSHADE

(71) Applicant: Xiong Luo, Nantong (CN)

(72) Inventor: Xiong Luo, Nantong (CN)

( * ) Notice: Subject to any disclaimer, the term of this patent is extended or adjusted under 35 U.S.C. 154(b) by 192 days.

(21) Appl. No.: 17/595,057

(22) PCT Filed: Jul. 23, 2019

(86) PCT No.: PCT/CN2019/097179

§ 371 (c)(1),
(2) Date: Nov. 8, 2021

(87) PCT Pub. No.: WO2020/248337

PCT Pub. Date: Dec. 17, 2020

(65) Prior Publication Data

US 2022/0192330 A1 Jun. 23, 2022

(30) Foreign Application Priority Data

Jun. 10, 2019 (CN) ..... 201910495558.4

(51) Int. Cl.

| | |
|---|---|
| ***A45B 25/08*** | (2006.01) |
| ***A45B 19/00*** | (2006.01) |
| ***A45B 23/00*** | (2006.01) |
| ***A45B 25/02*** | (2006.01) |

(52) U.S. Cl.

CPC ..... *A45B 25/08* (2013.01); *A45B 19/00* (2013.01); *A45B 23/00* (2013.01); *A45B 25/02* (2013.01); *A45B 2019/004* (2013.01)

(58) Field of Classification Search

CPC ..... A45B 25/08

USPC ..... 135/43

See application file for complete search history.

(56) References Cited

U.S. PATENT DOCUMENTS

| | | | | |
|---|---|---|---|---|
| 1,031,868 A * | 7/1912 | Peterson | A45B 19/10 | 135/25.4 |
| 1,034,846 A * | 8/1912 | Thomas | A45B 19/10 | 135/25.4 |
| 3,258,021 A * | 6/1966 | Tartaglia | A45B 25/06 | 135/43 |
| 7,963,293 B2 * | 6/2011 | Ma | A45B 25/14 | 135/37 |
| 8,127,780 B2 * | 3/2012 | Tung | A45B 19/04 | 135/98 |

FOREIGN PATENT DOCUMENTS

| | | | |
|---|---|---|---|
| CN | 2472558 Y * | 1/2002 | |
| DE | 202015003452 U1 * | 9/2015 | A45B 25/06 |

* cited by examiner

*Primary Examiner* — Noah Chandler Hawk
(74) *Attorney, Agent, or Firm* — Wang Law Firm, Inc.

(57) ABSTRACT

A hand-push umbrella has a column, an upper nest at the top of the column, a lower nest on the column, a plurality of long rods having an upper end mounted on the upper nest and a plurality of first short rods having a lower end mounted on the lower nest and an upper end hinged to the middle portion of the long rod; a first retainer ring sleeved on the column above the lower nest and fixed with the column, a handle is connected to the bottom of the lower nest, and a handle control mechanism is disposed inside the lower nest. The umbrella is simple and can be easily unfolded and folded. A tray and a plurality of second short stretchers greatly strengthen the support to the canopy and improve the stability of the structure.

8 Claims, 5 Drawing Sheets

HAND-PUSH SUNSHADE

TECHNICAL FIELD OF THE INVENTION

The present invention relates to an umbrella, in particular to a hand-push umbrella.

BACKGROUND OF THE INVENTION

As an outdoor leisure appliance, umbrellas are widely used in squares, beaches, parks, courtyards and other leisure places, providing a comfortable space for people to enjoy the cool. Existing umbrellas generally consist of a column, a frame, and a canopy. The frame is connected to the top of the column, the column is mainly used for supporting the frame, and the canopy is connected to the frame. When the frame is unfolded, the canopy is also unfolded, so that the umbrella is unfolded. The umbrellas are usually equipped with a stay rope structure thereon due to being very large and tall, i.e., one end of a rope is fixed on the frame, while the other end thereof is connected to a winch on the column. When in use, a handle of the winch rotates to tension the rope so that the frame rises to unfold the umbrella. Due to the slow operation speed of the winch, it takes time and effort to unfold the umbrella, which is also inefficient and inconvenient in use. With the improvement of living standards, the future development trend of umbrellas is to invent an umbrella that can be unfolded and folded with less effort and can be easily adjusted and fixed.

Upon inquiry, the existing Chinese patent No. CN201020300132, titled "Hand-push Lifting Umbrella", comprises a frame, a column, a pull rod, a handle assembly, and a rack; the frame comprises an upper tray, rods, stretchers and a lower tray, wherein the upper tray is connected to the rods, the stretchers are connected between the rods and the lower tray, and the lower tray is fixed to the column; the handle assembly comprises a handle main body, a spring and a button, where the handle main body consists of a hollow cylinder and a grip connected to the cylinder, the button is disposed in the grip, the spring is disposed between the button and an inner wall of the grip, and one end of the button extends out of an wall of the cylinder and enters an inner hole of the cylinder while the other end thereof extends out of the grip and enters a hole of the grip; the pull rod, having an upper end fixed to the upper tray and a lower end fixed to the handle assembly, is inserted into the column; and the cylinder of the handle assembly is partially sleeved on the column, the rack is fixed in the column, and a tooth surface of the rack is fitted to one end of the button to limit the movement of the column. A canopy of the umbrella can be easily unfolded and folded through the handle assembly, but the umbrella is high in cost due to numerous components.

Also, the Chinese patent No. CN201420712088, titled "Hand-push Umbrella", comprises a column, an upper tray, a lower tray, long rods and short rods. The upper tray is fixed at the top of the column while the lower tray is movably disposed on the column, an upper end of each long rod is mounted on the upper tray, and a lower end of each short rod is mounted on the lower tray while an upper end thereof is hinged to the middle of each long rod, wherein a push handle, which is connected to the lower tray through a connecting rod and moves up and down along the column to drive the lower tray to move synchronously, is further sleeved below the lower tray on the column; when the umbrella is unfolded, the push handle moves up to a position within the reach of a user unfolding the umbrella. Such umbrella can be unfolded and folded by pushing the push handle up or down, but it is hard to unfold a canopy to a proper position without a positioning mechanism.

SUMMARY OF THE INVENTION

It is an object of the present invention to provide a hand-push umbrella which is simple in structure and easily unfolded and folded in proper positions.

For achieving the object, a hand-push umbrella comprises a vertical column having a top; an upper nest operated by a movable ejector rod and capable of moving up and down along the column; a lower nest having a bottom and a top and being movably sleeved on the column; a plurality of long rods, each having an upper end mounted on the upper nest, an upper portion, a middle portion and a lower end; a canopy connected to the plurality of long rods; a plurality of first short rods, each having a lower end mounted on the lower nest, and an upper end hinged to the middle portion of the long rod; wherein, a first retainer ring is sleeved on the column above the lower nest, and the first retainer ring is fixed with the column and located at a position that limits upward movement of the lower nest when the canopy is in an open position; a handle is connected to the bottom of the lower nest, and a handle control mechanism, which is capable of locking and unlocking with the first retainer ring, is disposed inside the lower nest.

Preferably, the handle control mechanism comprises a second retainer ring and a sleeve with a top and a bottom, the handle is a circular tube having a top and a bottom and is movable and limitedly rotatably sleeved on the column, and the top of the handle is connected to the sleeve which is capable of rotating with the handle; the lower nest has an annular gap for receiving the first retainer ring at top of the lower nest, the second retainer ring is transversely movable and is disposed inside the lower nest located above the sleeve; the first retainer ring has an annular neck on the periphery of the first retainer ring, while the second retainer ring has a limiting protrusion capable of being blocked inside the annular neck protruding on the left side of the second retainer ring, the second retainer ring also has a locking block protruding diagonally opposite to the limiting protrusion; when the lower nest upward movement is limited by the first retainer ring, the limiting protrusion is located inside the annular neck and is blocked by the first retainer ring, so as to lock the canopy in an open position; the sleeve has a pushing protrusion for pushing the second retainer ring disposed on the top of the sleeve; when the sleeve rotates with the handle, the pushing protrusion rotates to the left side of the second retainer ring and is capable of pushing the locking block to force the second retainer ring move leftward, so as to make the limiting protrusion be detached from the annular neck of the first retainer ring, accordingly, the lower nest is unlocked with the first retainer ring and the canopy can be folded.

Preferably, the first retainer ring has a truncated cone bottom for fitting into the lower nest; the second retainer ring has a spring rod protruding on the periphery surface of the left side of the second retainer ring, and the lower nest has a corresponding spring hole, a spring, with two ends respectively sleeved on the spring rod and located inside the spring hole on the lower nest, keeps the limiting protrusion of the second retainer ring blocked inside the annular neck of the first retainer ring.

Preferably, the sleeve has a step on the top of the sleeve, and the top of the sleeve is limited inside the lower nest, the bottom of the sleeve extends out of the lower nest, the top of the handle is inserted into the lower nest and connected to the sleeve; the pushing protrusion of the sleeve is disposed on an outer edge of a rear side of the top of the sleeve and resists against the periphery of the second retainer ring; when the sleeve rotates clockwise under the rotation of the handle, the pushing protrusion rotates to a right side of the second retainer ring and diagonally opposite to the limiting protrusion, accordingly, the second retainer ring is capable of being pushed by the pushing protrusion to move leftward against the force of the spring, so that the limiting protrusion is detached from the annular neck.

Preferably, the second retainer ring has a stopper configured to stop the rotation of the pushing protrusion, the stopper is protruding on the peripheral surface of the second retainer ring.

Preferably, a returning spring is disposed between the step on the top of the sleeve and the inner wall of the lower nest; when the handle is released, the returning spring forces the sleeve to return to an original position, and the spring forces the second retainer ring to return to an original position.

Preferably, a fixed tray located above the retainer ring is disposed on the column, and a plurality of second short rods configured to strengthen the support to the canopy are mounted on the tray, one end of each short rod is connected to the tray, and the other end of each second short rod is hinged to the upper portion of the long rod.

Preferably, both the pushing protrusion and the locking block have an inclined guide surface for pushing the locking block.

Finally, a lock hole for receiving the locking block is disposed on the inner wall of the lower nest.

Compared with the prior art, the present invention has following advantages. The first retainer ring is fixed on the column, and the handle control mechanism is disposed in the lower nest, so that the second retainer ring in the lower nest can be clamped with the first retainer ring as long as the handle is pushed up, thus locking the unfolding state of the canopy stably and reliably. When there is a need to fold the umbrella, the canopy is folded as long as the second retainer ring is detached from the first retainer ring by rotating the handle clockwise, which is convenient and labor-saving. According to the present invention, the umbrella is simple and reasonable in structure, and can be easily and fast unfolded and folded. Furthermore, the addition of the tray and the second short stretchers greatly strengthen the support to the canopy and improve the stability of the structure.

DETAILED DESCRIPTION OF THE INVENTION

Figure 1:
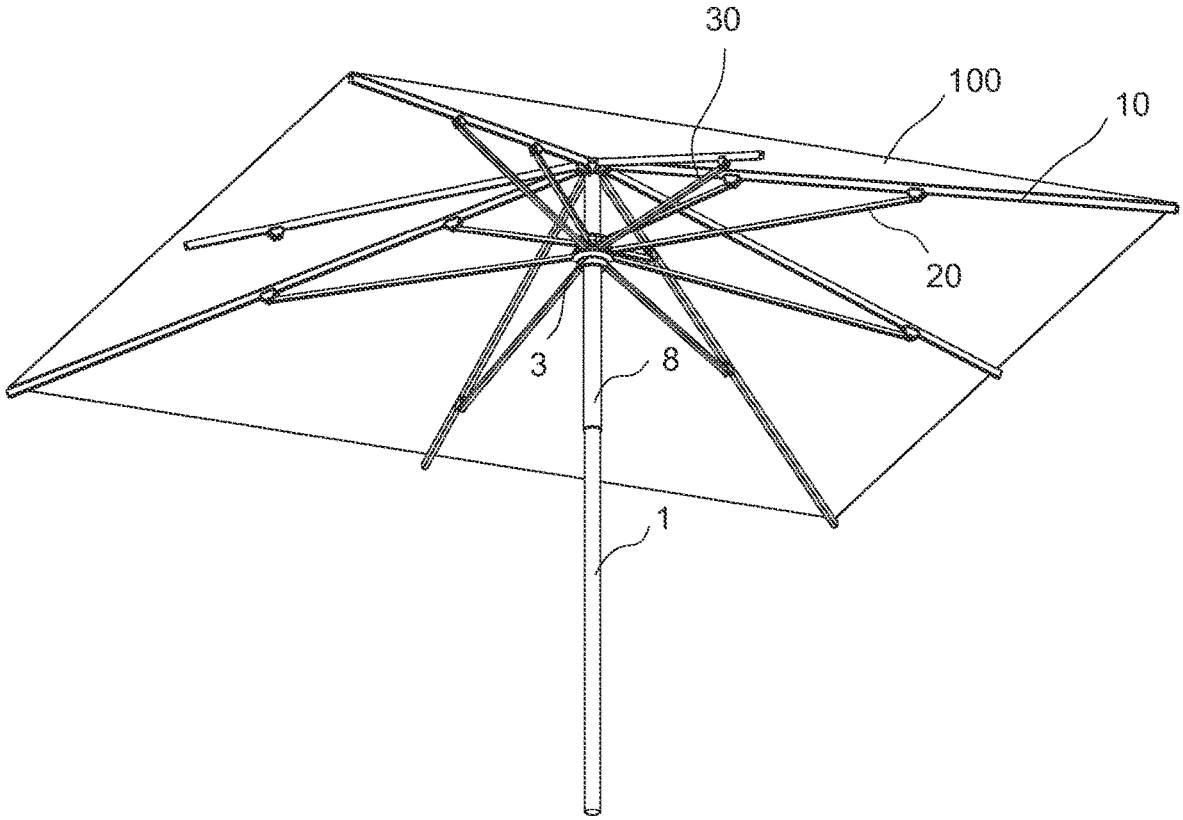
FIG. 1 is a perspective view of a hand-push umbrella according to an embodiment of the present invention.
Figure 2:
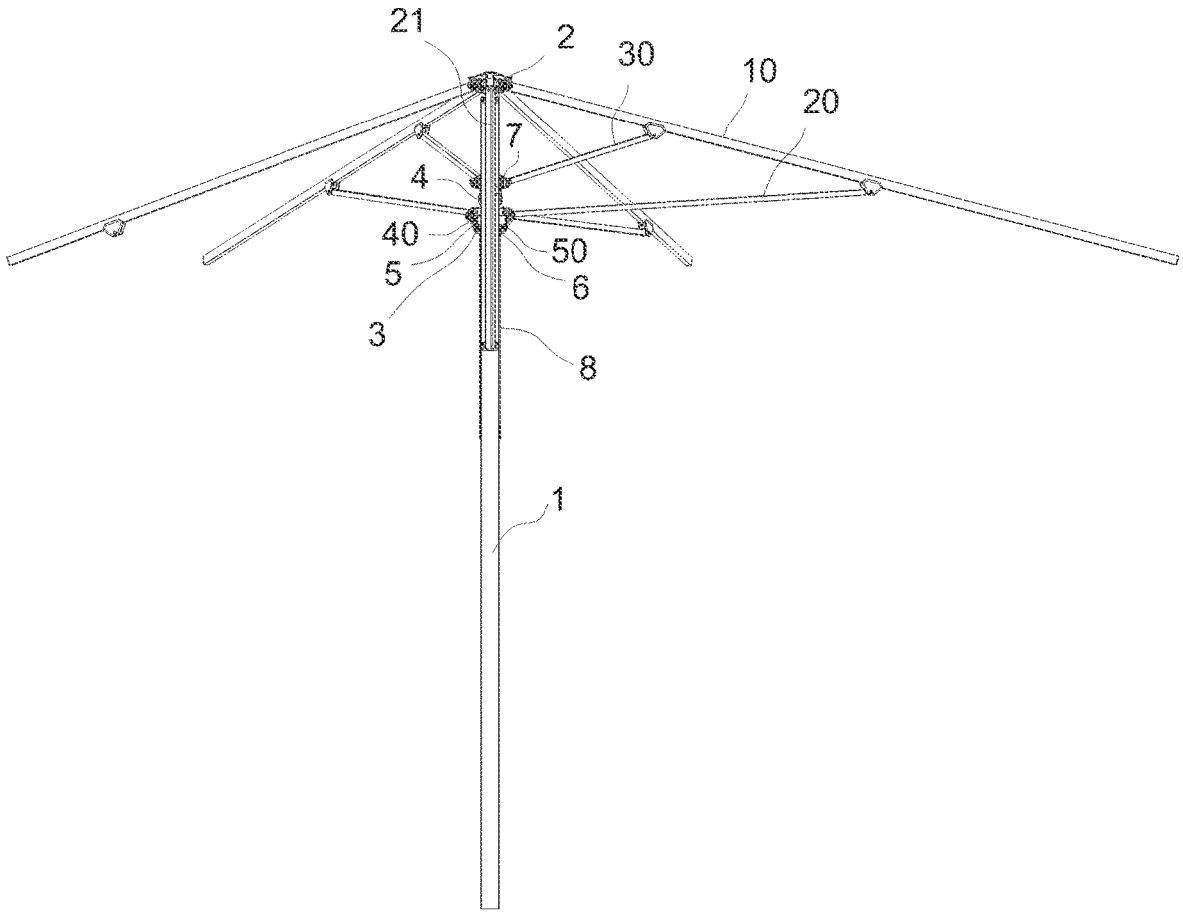
FIG. 2 is a perspective view of FIG. 1 without a canopy.

The present invention will be further described in detail by embodiments with reference to the accompanying drawings.

As shown in FIGS. 1 to 5, a hand-push umbrella comprises a column 1, an upper nest 2, a tray 7, a lower nest 3, a plurality of long rods 10, a plurality of first short rods 20, a plurality of second short rods 30, and a handle 8. A movable ejector rod 21 is fixed in the center of the upper nest 2 and can move up and down at the top of the column 1. The lower nest 3 is movably sleeved on the column 1, an upper end of each long rod 10 is hinged on the upper nest 2, and a lower end of each first short rod 20 is hinged on the lower nest 3 and an upper end thereof is hinged to the middle portion of the long rod 10. A first retainer ring 4 is sleeved on the column 1 above the lower nest 3, and the first retainer ring 4 is fixed with the column 1 and located at a position that limits upward movement of the lower nest 3 when a canopy 100 is in an open position. The tray is fixedly sleeved on the column 1 and located between the first retainer ring 4 and the upper nest 2. The second short rods 30 configured to strengthen the support to the canopy 100 are hinged on the tray 7, one end of each short rod 30 is connected to the tray 7, and the other end of each second short rod 30 is hinged to the upper portion of the long rod 10. A handle control mechanism, which is capable of locking and unlocking with the first retainer ring 4, is disposed inside the lower nest 3, the handle 8 is a circular tube having a top and a bottom and is movable and limitedly rotatably sleeved on the column 1, and an upper end of the handle 8 is connected to the handle control mechanism.

The handle control mechanism comprises a second retainer ring 5 and a sleeve 6 with a top and a bottom, the lower nest 3 has an annular gap for receiving the first retainer ring 4 at top of the lower nest 3, the second retainer ring 5 is transversely movable and is disposed inside the lower nest 3 located above the sleeve 6; the first retainer ring 4 has an annular neck 41 on the periphery of the first retainer ring 4, while the second retainer ring 5 has a limiting protrusion 51 capable of being blocked inside the annular neck 41 protruding on the left side of the second retainer ring 5; when the lower nest 3 upward movement is limited by the first retainer ring 4, the limiting protrusion 51 is located inside the annular neck 41 and is blocked by the first retainer ring 4, so as to lock the canopy 100 in an open position. The first retainer ring 4 has a truncated cone bottom for fitting into the lower nest 3, the second retainer ring 5 has a spring rod 53 protruding on the periphery surface of the left side of the second retainer ring 5, and the lower nest 3 has a corresponding spring hole, a spring 40, with two ends respectively sleeved on the spring rod 53 and located inside the spring hole on the lower nest 3, keeps the limiting protrusion 51 of the second retainer ring 5 blocked inside the annular neck 41 of the first retainer ring 4. The sleeve 6 has a step on the top of the sleeve 6, and the top of the sleeve 6 is limited inside the lower nest 3, the bottom of the sleeve 6 extends out of the lower nest 3, the top of the handle 8 is inserted into the lower nest 3 and connected to the sleeve 6, and can drive the sleeve 6 to rotate. A pushing protrusion 61 which can push the second retainer ring 5 is convexly disposed on the upper end of the sleeve 6, and disposed on an outer edge of a rear side of the top of the sleeve 6 and resists against the periphery of the second retainer ring 5. Correspondingly, the second retainer ring 5 has a locking block 54 protruding diagonally opposite to the limiting protrusion 51, a matching lock hole is formed on an inner wall surface of the lower nest 3, and both the pushing protrusion 61 and the locking block 54 are provided with a guide bevel that facilitates pushing the locking block 54. When the sleeve 6 rotates clockwise under the rotation of the handle 8, the pushing protrusion 61 rotates to a right side of the second retainer ring 5 and diagonally opposite to the limiting protrusion 51 to push the locking block 54, the second retainer ring 5 is capable of being pushed by the pushing protrusion 61 to move leftward against the force of the spring 40, so that the limiting protrusion 51 is detached from the annular neck 41, while the locking block 54 is also detached from the matching lock hole, so that the canopy 100 is folded. The second retainer ring 5 has a stopper 52 configured to stop the rotation of the pushing protrusion 61, the stopper is protruding on the peripheral surface of the second retainer ring 5, and a returning spring 50 is disposed between the step on the top of the sleeve 6 and the inner wall of the lower nest 3, when the handle 8 is released, the returning spring 50 forces the sleeve 6 to return to an original position, and the spring 40 forces the second retainer ring 5 to return to an original position.

Figure 3:
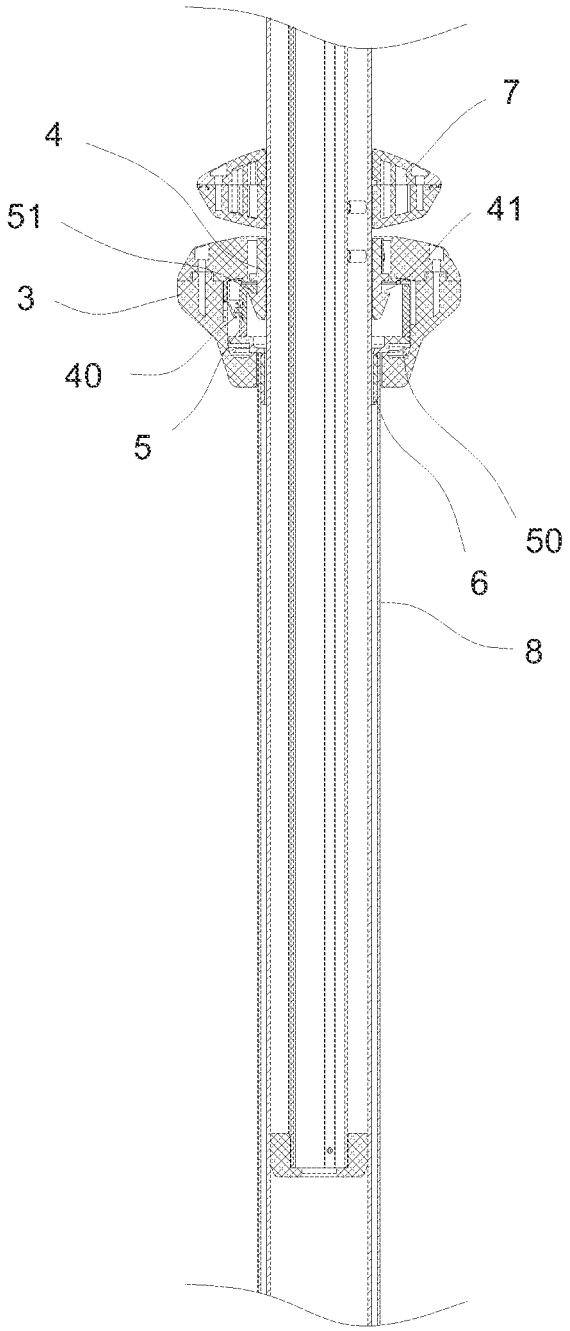
FIG. 3 is a sectional view according to the embodiment of the present invention in which a lower nest is locked with a first retainer ring.
Figure 4:
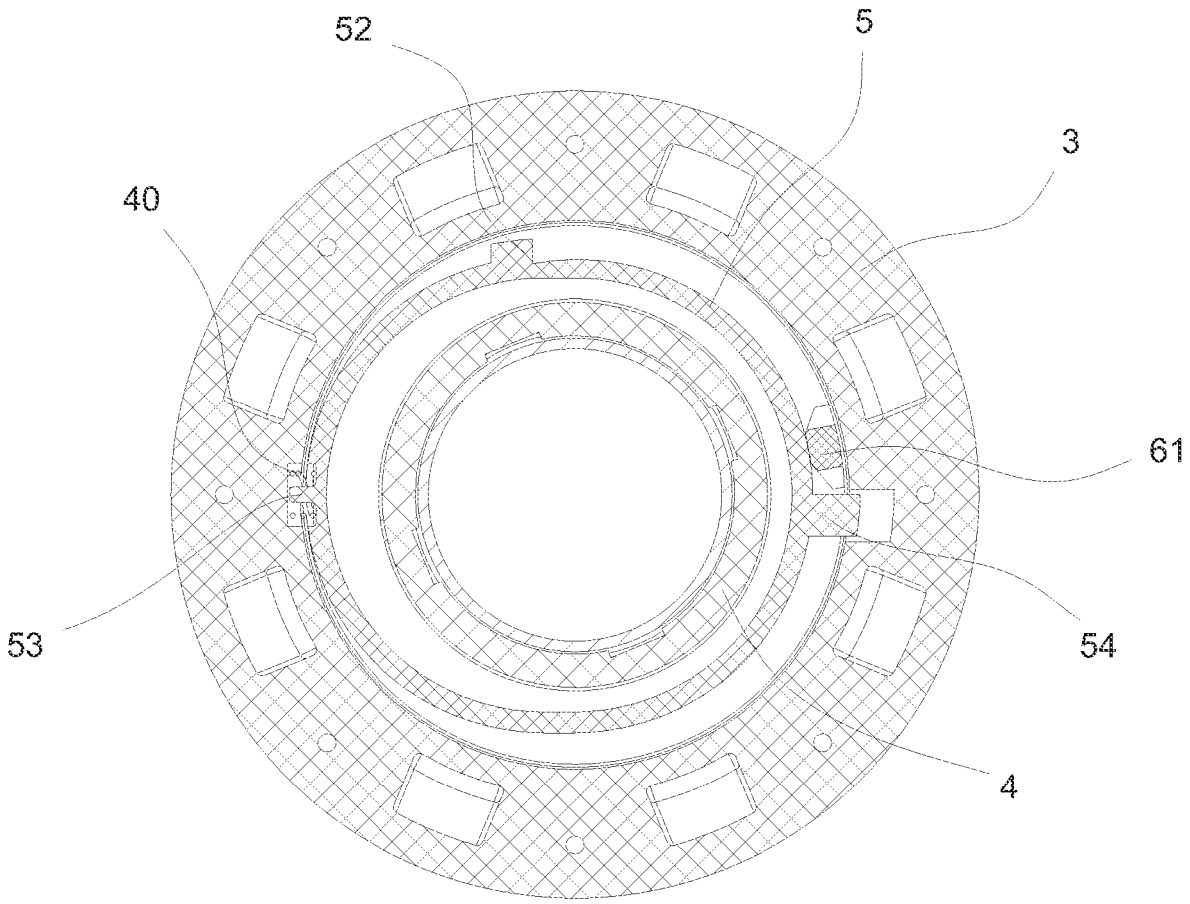
FIG. 4 is a sectional view according to the embodiment of the present invention in which a handle drives a sleeve to rotate and a pushing protrusion pushes a second retainer ring.
Figure 5:
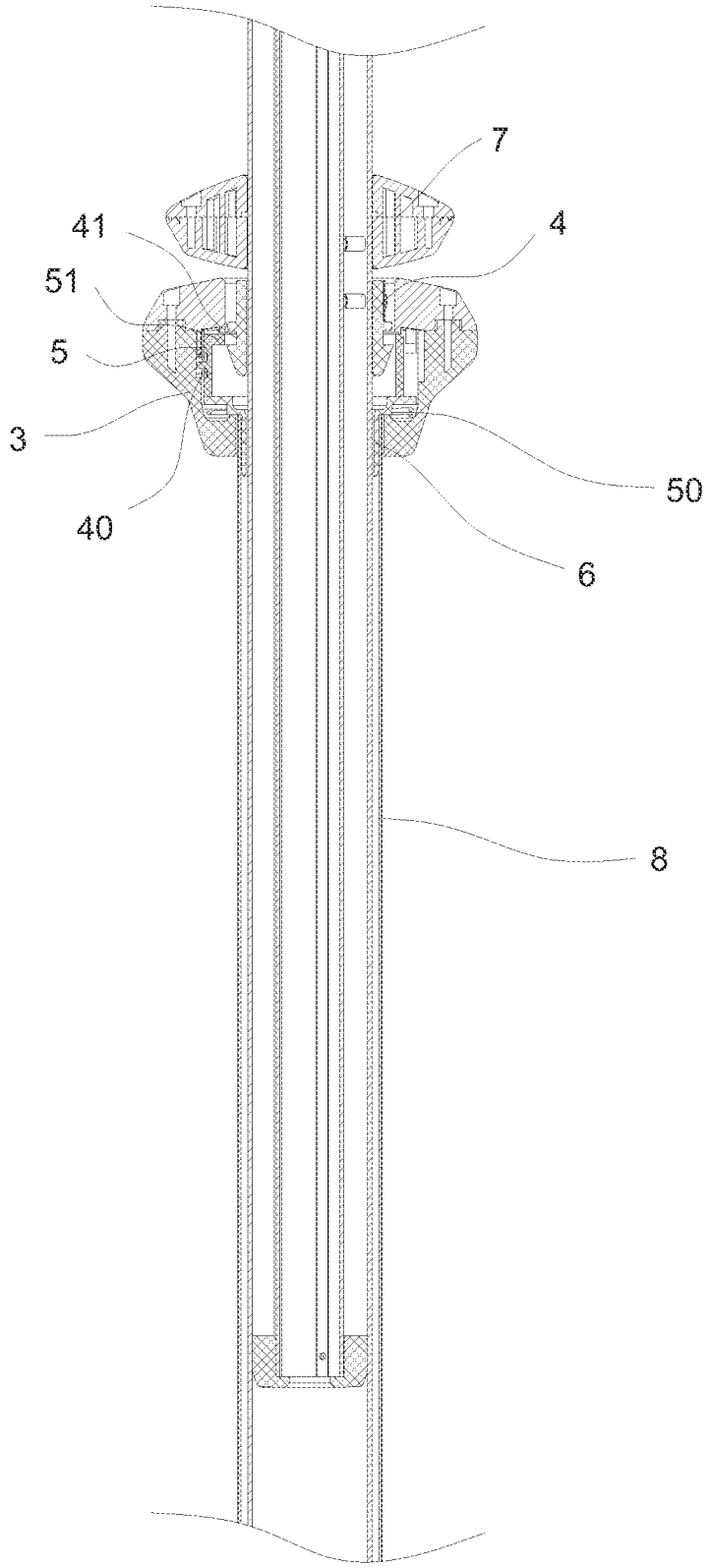
FIG. 5 is a sectional view according to the embodiment of the present invention in which the lower nest is detached from the first retainer ring.

When in use, the handle 8 is pushed upward so that the first retainer ring 4 is inserted into the lower nest 3, the second retainer ring 5 is clamped and locked with the first retainer ring 4 under the action of the spring 40, and the locking block 54 is locked with the lock hole on the inner wall surface of the lower nest 3. As shown in FIG. 3, the unfolding state of the canopy 100 can be locked. When the sleeve 6 rotates clockwise under the rotation of the handle 8, the pushing protrusion 61 on the sleeve 6 pushes the second retainer ring 5 to move leftward against the force of the spring 40. As shown in FIG. 4, the second retainer ring 5 is detached from the first retainer ring 4, and the locking block 54 is also detached from the matching lock hole. As shown in FIG. 5, after the handle 8 is pulled down, the canopy 100 can be folded. After the canopy 100 is folded and the handle 8 is released, the returning spring 50 forces the sleeve 6 to return to an original position during which the pushing protrusion 61 is detached from the second retainer ring 5 and the spring 40 forces the second retainer ring 5 to return to an original position.

The protection scope of the present invention is not limited to each embodiments described in this description. Any changes and replacements made on the basis of the scope of the present invention patent and of the description shall be included in the scope of the present invention patent.

The invention claimed is:

1. A hand-push umbrella, comprising:

a vertical column having a top;

an upper nest operated by a movable ejector rod and capable of moving up and down along the column;

a lower nest having a bottom and a top and being movably sleeved on the column;

a plurality of long rods, each having an upper end mounted on the upper nest, an upper portion, a middle portion and a lower end;

a canopy connected to the plurality of long rods;

a plurality of first short rods, each having a lower end mounted on the lower nest, and an upper end hinged to the middle portion of the long rod;

wherein, a first retainer ring is sleeved on the column above the lower nest, and the first retainer ring is fixed with the column and located at a position that limits upward movement of the lower nest when the canopy is in an open position;

a handle is connected to the bottom of the lower nest, and a handle control mechanism, which is capable of locking and unlocking with the first retainer ring, is disposed inside the lower nest;

the handle control mechanism comprises a second retainer ring and a sleeve with a top and a bottom, the handle is a circular tube having a top and a bottom and is movable and limitedly rotatably sleeved on the column, and the top of the handle is connected to the sleeve which is capable of rotating with the handle;

the lower nest has an annular gap for receiving the first retainer ring at top of the lower nest, the second retainer ring is transversely movable and is disposed inside the lower nest located above the sleeve;

the first retainer ring has an annular neck on the periphery of the first retainer ring, while the second retainer ring has a limiting protrusion capable of being blocked inside the annular neck protruding on the left side of the second retainer ring, the second retainer ring also has a locking block protruding diagonally opposite to the limiting protrusion;

when the lower nest upward movement is limited by the first retainer ring, the limiting protrusion is located inside the annular neck and is blocked by the first retainer ring, so as to lock the canopy in an open position;

the sleeve has a pushing protrusion for pushing the second retainer ring disposed on the top of the sleeve;

when the sleeve rotates with the handle, the pushing protrusion rotates to the left side of the second retainer ring and is capable of pushing the locking block to force the second retainer ring move leftward, so as to make the limiting protrusion be detached from the annular neck of the first retainer ring, accordingly, the lower nest is unlocked with the first retainer ring and the canopy can be folded.

2. The umbrella of claim 1, wherein the first retainer ring has a truncated cone bottom for fitting into the lower nest;

the second retainer ring has a spring rod protruding on the periphery surface of the left side of the second retainer ring, and the lower nest has a corresponding spring hole, a spring, with two ends respectively sleeved on the spring rod and located inside the spring hole on the lower nest, keeps the limiting protrusion of the second retainer ring blocked inside the annular neck of the first retainer ring.

3. The umbrella of claim 2, wherein the sleeve has a step on the top of the sleeve, and the top of the sleeve is limited inside the lower nest, the bottom of the sleeve extends out of the lower nest, the top of the handle is inserted into the lower nest and connected to the sleeve;

the pushing protrusion of the sleeve is disposed on an outer edge of a rear side of the top of the sleeve and resists against the periphery of the second retainer ring;

when the sleeve rotates clockwise under the rotation of the handle, the pushing protrusion rotates to a right side of the second retainer ring and diagonally opposite to the limiting protrusion, accordingly, the second retainer ring is capable of being pushed by the pushing protrusion to move leftward against the force of the spring, so that the limiting protrusion is detached from the annular neck.

4. The umbrella of claim 3, wherein the second retainer ring has a stopper configured to stop the rotation of the pushing protrusion, the stopper is protruding on the peripheral surface of the second retainer ring.

5. The umbrella of claim 4, wherein a returning spring is disposed between the step on the top of the sleeve and the inner wall of the lower nest;

when the handle is released, the returning spring forces the sleeve to return to an original position, and the spring forces the second retainer ring to return to an original position.

6. The umbrella of claim 1, wherein a fixed tray located above the retainer ring is disposed on the column, and a plurality of second short rods configured to strengthen the support to the canopy are mounted on the tray, one end of each short rod is connected to the tray, and the other end of each second short rod is hinged to the upper portion of the long rod.

7. The umbrella of claim 1, wherein both the pushing protrusion and the locking block have an inclined guide surface for pushing the locking block.

8. The umbrella base of claim 7, wherein a lock hole for receiving the locking block is disposed on the inner wall of the lower nest.

* * * * *